US008711660B2

(12) United States Patent
Bode et al.

(10) Patent No.: US 8,711,660 B2
(45) Date of Patent: Apr. 29, 2014

(54) TIMEPIECE

(75) Inventors: Nils Bode, Hannover (DE); Anthonie de Haas, Blasewitz (DE); Tino Bobe, Bärenfels (DE)

(73) Assignee: Lange Uhren GmbH, Glashuette (DE)

( * ) Notice: Subject to any disclaimer, the term of this patent is extended or adjusted under 35 U.S.C. 154(b) by 342 days.

(21) Appl. No.: 13/297,187

(22) Filed: Nov. 15, 2011

(65) Prior Publication Data

US 2012/0127837 A1 May 24, 2012

(30) Foreign Application Priority Data

Nov. 16, 2010 (DE) ..... 10 2010 043 954

(51) Int. Cl.

| | |
|---|---|
| ***G04B 19/02*** | (2006.01) |
| ***G04B 19/06*** | (2006.01) |
| ***G04B 19/08*** | (2006.01) |
| ***G04B 13/00*** | (2006.01) |

(52) U.S. Cl.

CPC ..... *G04B 19/025* (2013.01); *G04B 19/087* (2013.01); *G04B 13/00* (2013.01)

USPC ..... 368/228; 368/220

(58) Field of Classification Search

USPC ..... 368/80, 223, 228, 233, 236

See application file for complete search history.

(56) References Cited

U.S. PATENT DOCUMENTS

| | | | | |
|---|---|---|---|---|
| 5,222,053 | A * | 6/1993 | Ohhira | 368/73 |
| 6,229,768 | B1 * | 5/2001 | Nakazawa et al. | 368/223 |
| 6,761,478 | B2 | 7/2004 | Schmiedchen et al. | |
| 7,031,227 | B2 * | 4/2006 | Huter | 368/37 |
| 7,532,545 | B2 * | 5/2009 | Boileau | 368/28 |
| 8,036,066 | B2 | 10/2011 | Schlencker et al. | |
| 8,406,087 | B2 | 3/2013 | Schneider | |
| 2004/0095850 | A1 * | 5/2004 | Schmiedchen et al. | 368/190 |

FOREIGN PATENT DOCUMENTS

| | | |
|---|---|---|
| CH | 700808 | 10/2010 |
| CN | 2086913 | 10/1991 |
| CN | 101040226 | 9/2007 |
| CN | 101876810 | 11/2010 |
| WO | WO 02/077725 | 10/2002 |

OTHER PUBLICATIONS

Chronos Apr. 2008, p. 20.

* cited by examiner

*Primary Examiner* — Vit W Miska

(74) *Attorney, Agent, or Firm* — Cozen O'Connor

(57) ABSTRACT

A timepiece, particularly wristwatch, having a dial on which are arranged at least two circular scales having centers which are offset relative to one another. A first hand can sweep over the first scale and a second hand can sweep over the second scale, each hand being rotatable around a hand axis centric to the associated scale, and wherein the scales partially overlap. There is formed in the dial in the area surrounded by the first circular scale an aperture through which an area of the timepiece located behind the plane of the dial is visible. The circle segment of the second scale extending across the aperture is arranged on a separate scale carrier which is pivotable around a pivot axis coaxial to the hand axis of the second hand between a display position covering the aperture into a non-display position not covering the aperture.

12 Claims, 4 Drawing Sheets

TIMEPIECE

BACKGROUND OF THE INVENTION

1. Field of the Invention

The invention is directed to a timepiece, in particular a wristwatch, having a dial on which are arranged at least two circular scales having centers that are offset relative to one another, wherein a first hand can sweep over the first scale and a second hand can sweep over the second scale, each hand being rotatable around a hand axis centric to the associated scale, and wherein the scales partially overlap.

2. Description of the Related Art

In a timepiece of the kind mentioned above, the scales are so dimensioned that they must partially overlap. This is required for good readability particularly in a wristwatch because its dial has only a limited size.

SUMMARY OF THE INVENTION

It is an object of the invention to provide a timepiece of the type mentioned above in which the displays can easily be read by the hands and an area of the timepiece located behind the dial is also clearly visible from the front side of the timepiece.

According to one embodiment of the invention there is formed in the dial in the area surrounded by the first circular scale an aperture through which an area of the timepiece located behind the plane of the dial is visible, and in that the circle segment of the second scale extending across the aperture is arranged on a separate scale carrier which is pivotable around a pivot axis coaxial to the hand axis of the second hand between a display position covering the aperture into a non-display position not covering the aperture.

As a result of this construction, the scales can have a size which substantially covers the dial so that they are easily legible.

An aperture of sufficient dimensioning in an area surrounded by the one scale serves to render an area of the timepiece, e.g., a tourbillon, located behind the dial clearly visible from the front side.

To prevent a reduction in the size of this area due to the second scale extending over it, the scale carrier carrying this overlapping area of the second scale is brought into a position in which it overlaps the aperture only when, and for as long as, the hand of the second scale moves across the aperture. In order that the scale carrier in its non-display position is not visible in a bothersome manner and cannot possibly cover any other areas of the dial, the scale carrier can be arranged in a plane located behind the plane of the dial and, in the non-display position, can be pivotable into an area covered by the dial.

The scale carrier can be pivotably driven manually between its display position and its non-display position.

The scale carrier can preferably be drivable such that it can be moved into its display position during the movement path of the second hand over the aperture and into its non-display position when the second hand leaves its movement path over the aperture, and the driving can be carried out by means of the timepiece movement.

In order to facilitate the drive, the scale carrier can be pivotably driven in steps around a determined pivot angle.

In order to reduce the pivot angle of the scale carrier, the scale carrier can have two identical circle segments of the scale diametrically opposite one another with respect to the pivot angle and can be pivotably drivable by 90-degree steps.

In so doing, the second scale can be a twelve-hour scale, the second hand can be an hour hand, and the scale carrier can be pivotable onward by a 90-degree step every six hours.

A stepping device by which the scale carrier is pivotably drivable by steps can be rotatably drivable by a timepiece movement for the pivoting driving of the scale carrier.

In one embodiment, the stepping device has a stepping wheel which is drivable by the timepiece movement and which has, during a revolution, a leading area which follows a pause area and around which the stepping wheel is drivable in a leading manner relative to its otherwise uniform rotating movement. The stepping wheel can be fixedly connected to a spiral cam disk and a switching cam contacts the radially circumferential cam contour thereof in a spring-loaded manner.

A drive wheel is advantageously rotatably drivable by the timepiece movement and the cam disk which is rotatable coaxial to the drive wheel is rotatably drivable by the drive wheel, the cam disk is freely rotatable relative to the drive wheel around the leading area, and the cam disk has a pin which projects parallel to the axis of rotation of the cam disk and drive wheel into a semicircular groove in the drive wheel, which semicircular groove is concentric to the axis of rotation, and the leading area is determined by the length of the semicircular groove.

A switching disk wheel is advantageously rotatably drivable by the stepping wheel and has a stepping tooth which engages once per revolution in a stepping pinion and rotates this stepping pinion forward by a step, and the stepping pinion is coaxially connected to the scale carrier.

In order to arrest the scale carrier in its display position or non-display position beyond the stepping process, a locking disk having a circular cross section can be coaxially connected to the switching disk wheel, this locking disk having at its radially extending circumferential contour an insertion groove that projects radially inward, and a ratchet star is fixedly connected coaxially to the stepping pinion, which ratchet star is in sliding contact by the intermediate areas between its teeth with the circumferential contour of the locking disk, a tooth of the ratchet star entering into the insertion groove during a forward step.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An embodiment example of the invention is shown in the drawing and is described more fully in the following. In the drawings.

DETAILED DESCRIPTION OF THE PRESENTLY PREFERRED EMBODIMENTS

Figure 1:
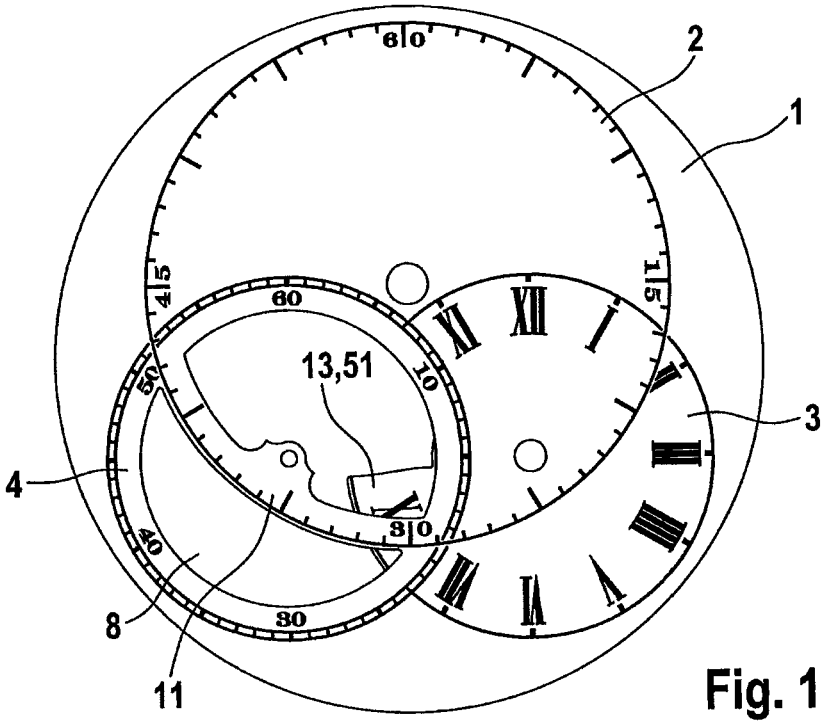
FIG. 1 is a top view of a dial of a timepiece having a sector of a scale carrier pivoting into the area of an aperture.

The timepiece shown in the drawings has a circular dial 1 on which are arranged a circular minutes scale 2 for a minutes hand 5, a circular hour scale 3 for an hour hand 6, and a circular seconds scale 4 for a seconds hand 7.

All three scales 2, 3 and 4 partially overlap.

Figure 2:
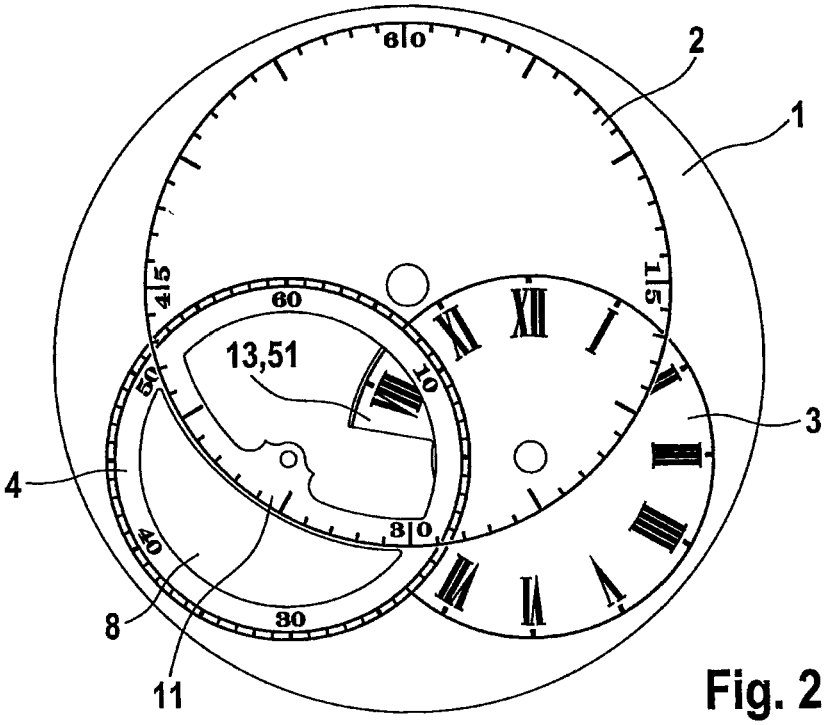
FIG. 2 is a top view of the dial according to FIG. 1 with the sector of the scale carrier pivoting out of the area of the aperture.
Figure 3:
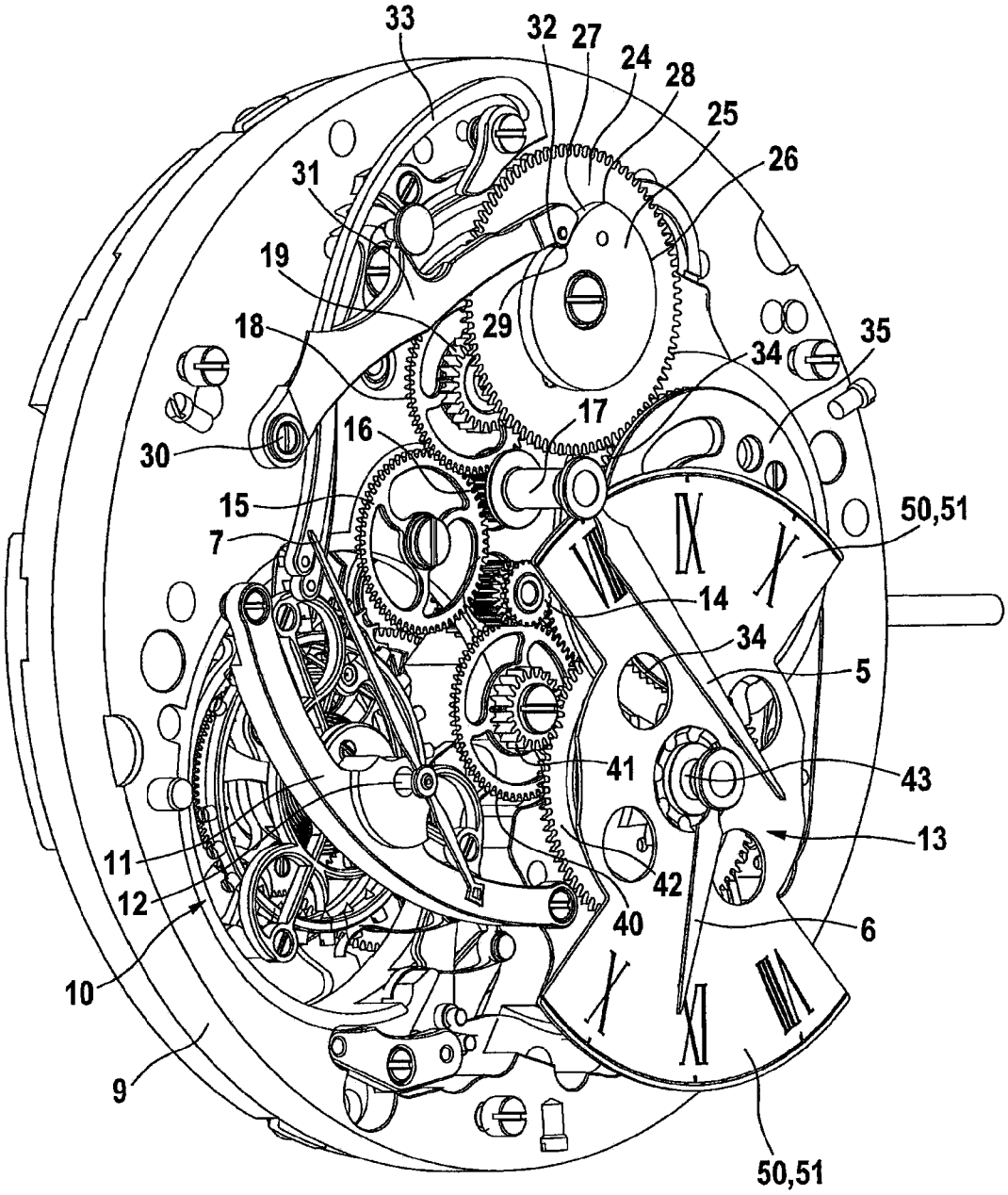
FIG. 3 is a perspective view of the timepiece according to FIG. 1 without dial.

The inner area of the seconds scale 4 has an aperture 8 in the dial 1 through which a tourbillon 10 arranged in the timepiece movement 9 in a plane behind the dial 1 is visible from the front side of the timepiece (FIGS. 1-3).

The aperture 8 is spanned in an arc-shaped manner corresponding to the shape of the minutes scale 2 by a bridging piece 11 provided with the minutes scale 2 and has the bearing of a seconds spindle 12 carrying the seconds hand 7.

The circle segment 51 of the hour scale 3 extending across the area of the aperture 8 is arranged not on the dial 1 but rather on a scale carrier 13 which is separate from the dial 1.

Figures 4, 5, 7:
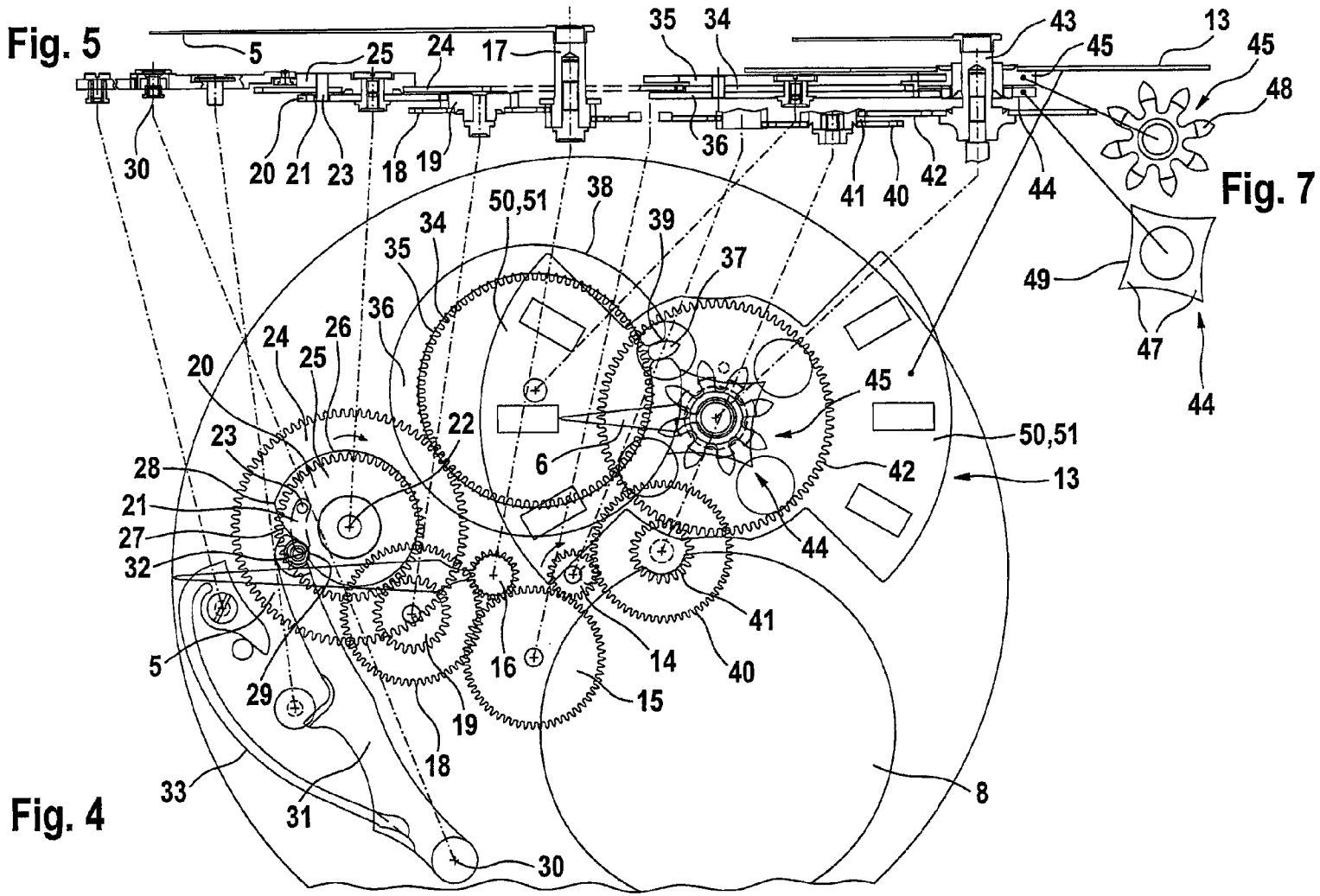
FIG. 4 is a schematic top view of the timepiece according to FIG. 1 without dial.
FIG. 5 is a schematic side view of the schematic view according to FIG. 4.
FIG. 7 is a top view of the stepping pinion and ratchet star of the timepiece according to FIG. 3.
Figure 6:
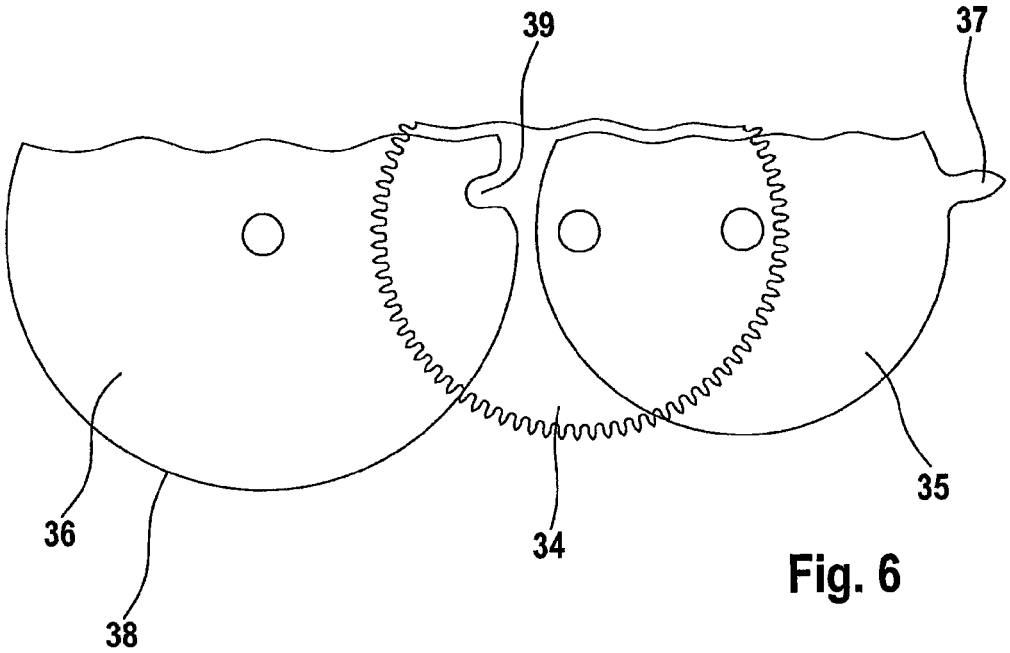
FIG. 6 is an exploded view of a constructional unit comprising switching disk wheel, switching disk and locking disk of the timepiece according to FIG. 3.

A pinion 14 which is drivable in clockwise direction by a timepiece movement, not shown, at one revolution per hour engages in an intermediate wheel 15, and the intermediate wheel 15 engages in a minutes pinion 16 which is arranged on a cannon pinion 17 and is rotatably drivable at one revolution per hour and has the minutes hand 5 (FIGS. 3, 4).

The minutes pinion 16 drives a first minutes wheel 18 whose first minutes wheel pinion 19 in turn rotatably drives a drive wheel 20 (FIGS. 4, 5).

The drive wheel 20 has a concentric semicircular groove 21 into which a pin 23 projects parallel to the axis of rotation 22 of the drive wheel 20.

The pin 23 is fixedly arranged at a stepping wheel 24 which is fixedly connected to a cam disk 25; the constructional unit comprising stepping wheel 24 and cam disk 25 is likewise supported so as to be rotatable around the axis of rotation 22.

This constructional unit comprising stepping wheel 24 and cam disk 25 is rotatable relative to the drive wheel 20 between the stop positions of the pin 23 at the two ends of the semicircular groove 21.

The cam disk 25 has a spiral radially circumferential cam contour 26 that ascends in the counterclockwise direction and which has a steep transition area 27 between the radially outer end 28 and the radially inner end 29 of the spiral of the cam contour 26.

A switching lever 31 which is supported by one end so as to be pivotable around a lever axis 30 parallel to the axis of rotation 22 has at its other end a freely rotatable switch roller which forms a switching cam 32 and which is acted upon by a spring 33 loading the switching lever 31 and contacting the cam contour 26.

The stepping wheel 24 engages in a switching disk wheel 34 which is fixedly connected coaxially to a switching disk 35 and a locking disk 36 so as to form a constructional unit (FIGS. 4, 7).

The switching disk 35 has a stepping tooth 37 projecting radially from its circular circumferential contour, and the locking disk 36 has an insertion groove 39 projecting radially inward at its circular radial circumferential contour 38.

The stepping tooth 37 and insertion groove 39 have the same radial orientation.

The constructional unit comprising switching disk wheel 34, switching disk 35 and locking disk 36 is driven in rotation at one revolution per six hours.

Further, the pinion 14 drives a second minutes wheel 40, the second minutes wheel pinion 41 of the second minutes wheel 40 drives an hour wheel 42 at one revolution per twelve hours.

The hour wheel 42 which is mounted so as to be freely rotatable has an hour wheel spindle 43 which carries the hour hand 6.

A constructional unit comprising a ratchet star 44 having four teeth 47, a stepping pinion 45 having eight teeth 48, and the scale carrier 13 is arranged on the hour wheel spindle 43 likewise so as to be freely rotatable. The ratchet star 44 is located in a plane with the locking disk 36, the stepping pinion 45 is located in a plane with the switching disk 35 and, above the latter from the view point of the observer, the scale carrier 13 is arranged in a plane beneath the plane of the dial 1 (FIGS. 4, 5, 7).

The stepping pinion 45 can be rotated onward by 90° by the stepping tooth 37. During this stepping movement, a tooth 47 of the ratchet star 44 penetrates at the same time into the insertion groove 39 of the locking disk 36.

Subsequently, the ratchet star 44 contacts the circumferential contour 38 of the locking disk 36 by one of its intermediate areas 49 between two teeth 47 so that the ratchet star 44 and, therefore, also the stepping pinion 45 and scale carrier 13 are prevented from rotating until, after one revolution, the stepping tooth 37 engages in teeth 48 of the stepping pinion 45 and one of the teeth 47 of the ratchet star 44 engages in the insertion groove 39.

The scale carrier 13 has two diametrically opposed sectors 50 on which is respectively arranged the circle segment 51 of the hour scale 3 which extends across the aperture 8 so as to complete the hour scale 3.

The second minutes wheel 40 is rotatably driven by the pinion 14 which is driven in clockwise direction by a timepiece movement and the hour wheel 42 is rotatably driven at one revolution per twelve hours by the second minutes wheel pinion 41, so that the hour hand 6 also moves in a corresponding manner along the hour scale 3.

Further, the minutes pinion 16 is rotatably driven in clockwise direction by the pinion 14 via the intermediate wheel 15 so that the minutes hand 5 also moves in a corresponding manner along the minutes scale 2.

The drive wheel 20 is driven in clockwise direction by the minutes pinion 16 via the first minutes wheel 18 and the first minutes wheel pinion 19.

In the position shown in FIG. 4, the pin 23 of the stepping wheel 24 contacts the rear end of the semicircular groove 21 with reference to the direction of rotation so that the drive wheel 20 must first rotate until the other end of the semicircular groove 21 contacts the pin 23 before the stepping wheel 24 and the cam disk 25 are also carried along by the drive wheel 20.

The switching cam 32, which contacts the cam contour 26 in a pre-loaded manner, is guided radially outward by the ascending cam contour 26 until reaching the outer end 28 thereof.

Due to the fact that pre-loading is directed radially inward, the switching cam 32 exerts a forward-driving force in the ramp-like transition area 27 extending up to the inner end 29 of the cam contour 26 so that the stepping wheel 24 and the cam disk 25 lead ahead of the drive wheel 20 by the length of the semicircular groove 21 and are not carried along again until, as a result of further rotation of the drive wheel 20, the semicircular groove 21 of the drive wheel 20 comes into contact with the pin 23 by its front end with reference to the rotating direction.

The active leading movement of the stepping wheel 24 results correspondingly in a sudden further rotation of the switching disk wheel 34.

Since the stepping tooth 37 of the switching disk 35 is positioned immediately preceding an engagement in the teeth 48 of the stepping pinion 45 at this moment, it engages in the stepping pinion 45 due to the sudden movement of the switching disk wheel 34 and rotates the stepping pinion 45 by two teeth 48 and then disengages again from the stepping pinion 45.

This advancing of the stepping pinion 45 causes a sudden further rotation of the scale carrier 13 by 90°.

Accordingly, one of the sectors 50 of the scale carrier 13 either moves out of its non-display position covered by the dial 1 into a display position covering the aperture 8 and completing the hour scale 4 or exits the display position and moves into the non-display position (FIG. 4).

In the non-display position, both sectors 50 are covered by the dial 1 and are not visible to an observer.

The drives of stepping pinion 45 and hour wheel 42 are adjusted to one another in such a way that an advancing of the scale carrier 13 is always only carried out when the hour hand 7 is in the six o'clock position and in the twelve o'clock position.

Therefore, one sector 50 of the scale carrier 13 covers the aperture 8 only when the hour hand 6 is located in the area of the hour scale 3 extending across the aperture 8.

When the hour hand 6 is located in an area of the hour scale 3 arranged on the dial 1, the tourbillon 10 is visible through the aperture 8.

To arrest the scale carrier 13 beyond an advancing movement in its display position and non-display position, the ratchet star 44 contacts the circumferential contour 38 of the locking disk 36 by an intermediate region 49 between two of its teeth 47 during these phases, and only during an advancing movement of the scale carrier 13 allows this advancing movement through insertion of a tooth 47 into the insertion groove 39 which is then located opposite it.

Figure 8:
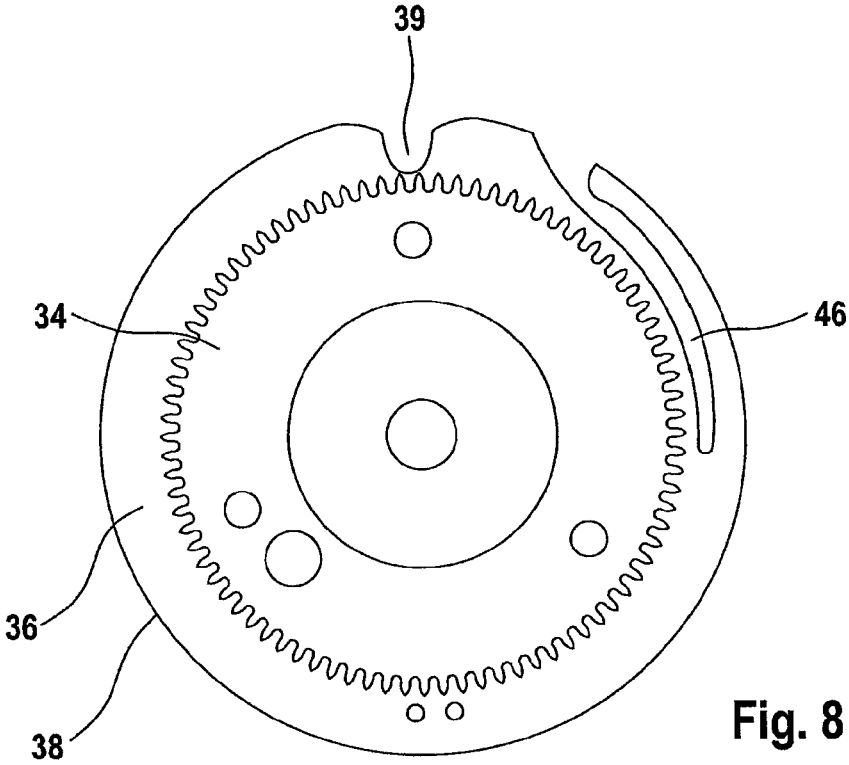
FIG. 8 is a view of a second embodiment example of a locking disk.

In FIG. 8, the switching disk wheel 34 and the locking disk 36 form a constructional unit. A slot 46 is formed in the locking disk 36 which extends along a part of the circumference of the locking disk parallel to the circumferential contour 38 thereof and opens outward near the insertion groove 39 at the circumferential contour 38.

The circumferential contour which is somewhat radially elastic in the area of the slot 46 cushions a hard stopping of the ratchet star 44 against the circumferential contour 38 during an advancing process.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A timepiece, comprising:

a dial on which are arranged at least two circular scales having centers which are offset relative to one another;

a first hand configured to sweep over the first scale;

a second hand configured to sweep over a second scale, the first and second scales partially overlapping, wherein each hand is rotatable around a respective hand axis centric to its associated scale, a dial having an aperture in an area surrounded by the first scale through which an area of the timepiece, located behind a plane of the dial, is visible;

a circle segment of the second scale configured to extend across the aperture is arranged on a scale carrier that is pivotable around a pivot axis coaxial to the hand axis of the second hand between a display position covering the aperture into a non-display position not covering the aperture.

2. The timepiece according to claim 1, wherein the scale carrier is arranged in a second plane located behind the plane of the dial and, in the non-display position, the scale carrier is pivotable into an area covered by the dial.

3. The timepiece according to claim 2, wherein the scale carrier is drivable such that it can be moved into its display position during movement path of the second hand over the aperture and into its non-display position when the second hand leaves its movement path over the aperture.

4. The timepiece according to claim 1, wherein the scale carrier has two substantially identical circle segments of the second scale diametrically opposite one another with respect to the pivot angle and is pivotably drivable by 90-degree steps.

5. The timepiece according to claim 1, further comprising a stepping device by which the scale carrier is pivotably drivable by steps is rotatably drivable by a timepiece movement of the timepiece.

6. The timepiece according to claim 5, wherein the stepping device has a stepping wheel drivable by the timepiece movement and which has, during a revolution, a leading area which follows a pause area and around which the stepping wheel is drivable in a leading manner relative to its otherwise uniform rotating movement.

7. The timepiece according to claim 6, wherein the stepping wheel is fixedly connected to a spiral cam disk, and a switching cam contacts the radial circumferential cam contour thereof in a spring-loaded manner.

8. The timepiece according to claim 7, further comprising a drive wheel rotatably drivable by the timepiece movement and the cam disk which is rotatable coaxial to the drive wheel, wherein the cam disk is freely rotatable relative to the drive wheel around the leading area.

9. The timepiece according to claim 8, wherein the cam disk has a pin that projects parallel to the axis of rotation of the cam disk and the drive wheel into a semicircular groove in the drive wheel, which semicircular groove is concentric to the axis of rotation, wherein the leading area is determined by the length of the semicircular groove.

10. The timepiece according to claim 6, further comprising a switching disk wheel that is rotatably drivable by the stepping wheel and has a stepping tooth that engages once per revolution in a stepping pinion and rotates the latter onward by a step, wherein the stepping pinion is coaxially connected to the scale carrier.

11. The timepiece according to claim 9, further comprising a switching disk wheel that is rotatably drivable by the stepping wheel and has a stepping tooth that engages once per revolution in a stepping pinion and rotates the latter onward by a step, wherein the stepping pinion is coaxially connected to the scale carrier.

12. The timepiece according to claim 1, wherein the timepiece is a wristwatch.

* * * * *